US011843178B1

(12) United States Patent
McCarrick

(10) Patent No.: US 11,843,178 B1
(45) Date of Patent: Dec. 12, 2023

(54) COMPACT UNIT CELL PCB ANTENNA SYSTEM WITH WAVEGUIDE COUPLING

(71) Applicant: Micro-Ant, LLC, Jacksonville, FL (US)

(72) Inventor: Charles McCarrick, Jacksonville, FL (US)

( * ) Notice: Subject to any disclaimer, the term of this patent is extended or adjusted under 35 U.S.C. 154(b) by 0 days.

(21) Appl. No.: 18/322,172

(22) Filed: May 23, 2023

(51) Int. Cl.
*H01Q 21/24* (2006.01)
*H01Q 9/04* (2006.01)

(52) U.S. Cl.
CPC ..... *H01Q 21/24* (2013.01); *H01Q 9/0407* (2013.01)

(58) Field of Classification Search
CPC ..... H01Q 21/24; H01Q 9/0407
See application file for complete search history.

(56) References Cited

U.S. PATENT DOCUMENTS 9,048,248 B2 6/2015 Maurer et al.
9,865,935 B2 1/2018 Miraftab et al.
10,833,415 B2 11/2020 Rogers
10,903,581 B2 1/2021 Zhao et al.
11,121,475 B2 9/2021 Yang et al.
2009/0284440 A1* 11/2009 Weidmann ..... H01Q 21/065 343/893
2019/0348746 A1 11/2019 Gupta et al.
2022/0109246 A1 4/2022 Emanuelsson et al.
2023/0035968 A1 2/2023 Wodrich et al.
2023/0084399 A1 3/2023 Elovsson et al.
2023/0107707 A1 4/2023 Lim et al.

* cited by examiner

*Primary Examiner* — Dieu Hien T Duong
(74) *Attorney, Agent, or Firm* — Mark Young, PA

(57) ABSTRACT

An antenna assembly of PCB layers and waveguide layers includes a driven PCB layer with an array of unit cells. Each cell includes a central first element (e.g., a receive patch) and four second elements (e.g., transmit patches) evenly spaced around the first element in a square configuration. Distances between adjacent aligned first elements are equal, and less than the first elements' operating frequency. Distances between adjacent aligned second elements are equal, and less than the second elements' operating frequency. First and second combiner layer conductively couple first elements and second elements, respectively, to one or more first or second combiner pads to facilitate interfacing the elements with waveguides. First and second waveguides formed into separate plates communicatively coupled to their corresponding combiner layer.

20 Claims, 21 Drawing Sheets

SECTION A-A

DETAIL B

DETAIL C

SECTION A-A

DETAIL B

COMPACT UNIT CELL PCB ANTENNA SYSTEM WITH WAVEGUIDE COUPLING

FIELD OF THE INVENTION

This invention relates generally to an antenna array, and more particularly, to a multilayer PCB antenna array directly coupled to staked waveguides.

BACKGROUND OF THE INVENTION

In some antenna systems, such as satellite communications systems, a transmitting frequency (TX) differs from a receiving frequency (RX) to avoid radio interference. The data signal transmitted from an antenna to the satellite is called the uplink signal, and the data signal received by the antenna from the satellite is called the downlink signal. In the case of Ka-band, an uplink transmitting frequency TX may be about 30 GHz (e.g., 30.0-31.0 GHz), and the downlink receiving frequency RX may be 20 GHz (e.g., 20.2-21.2 GHz).

Ka-band terminals tend to be large, heavy and complex, because Ka-band systems require physical separation between transmit and receive antennas to cover the wide frequency range and avoid grating lobes. Many Ka-band antennas place the transmit antenna and receive antennas apart, but next to one another, requiring a larger surface area and increasing, size, weight and production costs.

Unintended beams of radiation, known as grating lobes occur in uniformly spaced arrays (arrays with an equal distance between adjacent elements) when the antenna element separation is too large. Sufficiently large spacing permits in-phase addition of radiated fields in more than one direction. In general, grating lobes will occur whenever the size of individual elements in an array equals or exceeds the wavelength. As grating lobes severely compromise gain-to-noise-temperature (G/T), they are extremely undesirable.

A compact cost-effective scalable PCB antenna array that avoids or minimizes grating lobes and achieves a high gain-to-noise-temperature (G/T) is needed. An antenna array that efficiently couples waveguides to a PCB stack is needed. An antenna array that stacks receive and transmit waveguides to reduce overall footprint is needed.

The invention is directed to overcoming one or more of the problems and solving one or more of the needs as set forth above.

SUMMARY OF THE INVENTION

To solve one or more of the problems set forth above, in an exemplary implementation of the invention, an antenna array is provided. The array features a driven layer. The driven layer is a PCB layer that includes unit cells. Each unit cell includes a first element and four second elements. The second elements are arranged in a square configuration with each second element being located at a corner of the square configuration. A center of each second element is equidistant from a center of each adjacent second element. The center of each second element is equidistant from a center of the first element. The second elements operate at a second frequency having a second wavelength. Each distance from the center of each second element and the center of each adjacent second element is less than the second wavelength.

The unit cells may be aligned in row and/or columns. In such a configuration, the center of the first element of each unit cell is equidistant from the center of each adjacent first element in the same row or same column. Each first element operates at a first frequency having a first wavelength. The distance from the center of each first element and the center of each adjacent first element in the same row or same column is less than the first wavelength. The second frequency is different from, greater than, the first frequency.

The orientations of second elements (e.g., transmit patches) within a unit cell vary in 90° increments. Proceeding in sequence, such as a clockwise or counterclockwise sequence, starting from any second element in a unit cell, the orientation of a second element to each aligned adjacent second element is different by 90°. Similarly, the orientations of first elements (e.g., receive patches) among aligned adjacent unit cells vary in 90° increments. Proceeding in sequence, such as a clockwise or counterclockwise sequence, starting from any first element in an array of aligned adjacent unit cells, the orientation of a first element to each aligned adjacent first element is different by 90°.

The first element of each unit cell may be configured for downlink, i.e., to receive radio frequency electromagnetic radiation at the first frequency. Each second element of each unit cell may be configured for uplink, i.e., to transmit radio frequency electromagnetic radiation at a second frequency. By way of example, the first frequency may be a Ka band downlink frequency and the second frequency may be a Ka band uplink frequency.

The antenna array may also include first and second combiner layers, each being a separate PCB layer. Preferably, all PCB layers have the same footprint. The first combiner layer conductively couples first elements to one or more first combiner pads. Likewise, the second combiner layer conductively couples second elements to one or more second combiner pads. There are fewer first combiner pads than there are first elements. Similarly, there are fewer second combiner pads than there are second elements. This reduction in numbers facilitates interfacing the elements with waveguides via the combiner pads.

By way of illustration, a first combiner layer may include a plurality of groups of first pads. Each group of first pads may include a plurality of first pads conductively coupled to a first combiner pad. Each first element of the driven layer is conductively coupled to one of the pluralities of first pads of the first combiner layer. Likewise, a second combiner layer may include a plurality of groups of second pads. Each group of second pads may include a plurality of second pads conductively coupled to a second combiner pad. Each second element of the driven layer is conductively coupled to one of the pluralities of second pads of the second combiner layer. Each group of the plurality of groups of first pads of the first combiner layer may contain 16 first pads coupled to one first combiner pad. Each group of the plurality of groups of second pads of the second combiner layer may contain 16 second pads coupled to one second combiner pad. This 16:1 reduction facilitates coupling with a waveguide, because the waveguide can couple with one combiner pad instead of sixteen times as many driven elements. Concomitantly, the reduction enables each waveguide to be milled (e.g., formed by CNC milling), using commercially available CNC machinery, in a single plate having a footprint that is the same as the footprint of the PCB layers.

Two separate waveguide layers are provided. Each waveguide layer is formed in a plate. One waveguide layer, i.e., the first waveguide layer, couples to the first combiner layer. The other waveguide layer, i.e., the second waveguide layer couples to the second waveguide layer. Whichever waveguide layer is disposed between the other waveguide layer and the combiner layers will have apertures in the form of waveguide channels exclusively for coupling the other waveguide layer to its corresponding combiner layer.

For example, the first waveguide layer may be a first conductive metallic layer with a first port extending therethrough, a plurality of interconnected first waveguide channels formed in the metallic layer and configured to propagate a first electromagnetic wave. The plurality of interconnected first waveguide channels may include an interconnected first waveguide channel with a first aperture corresponding to each first combiner pad. Each first aperture may be aligned with the corresponding first combiner pad. If the first elements coupled to the first combiner pads are receive elements, then each first aperture is configured to propagate the first electromagnetic wave from the corresponding first combiner pad to the interconnected first waveguide channel and to the first port. If the first waveguide layer is disposed between the second waveguide layer and the combiner layers, then the first conductive metallic layer also includes a plurality of openings, each being aligned with a second combiner pad.

A second waveguide layer for propagating a second electromagnetic wave includes a second conductive metallic layer with a second port extending therethrough. A plurality of interconnected second waveguide channels are formed in the metallic layer and configured to propagate the second electromagnetic wave. The plurality of interconnected second waveguide channels include an interconnected second waveguide channel with a second aperture corresponding to each second combiner pad. Each second aperture is aligned with a corresponding second combiner. Each second aperture is configured to propagate the second electromagnetic wave from the interconnected second waveguide channel to the corresponding second combiner pad via one of the openings of the plurality of openings of the first conductive metallic layer. The second conductive metallic layer further includes a window (i.e., aperture) aligned with the first port of the first conductive metallic layer.

The waveguide layers are disposed between the combiner layers and an interface layer. The interface layer is an adapter interface layer with a first waveguide adapter interface coupled with the window in the second conductive metallic layer of the second waveguide layer aligned with the first port of the first conductive metallic layer, and a second waveguide adapter interface coupled with the second port in the second conductive metallic layer of the second waveguide layer. The interface layer allows connection of the interfaces to coaxial or other waveguide adapters.

The first conductive metallic layer is preferably a first metal plate with each of the first port, the plurality of interconnected first waveguide channels, and each first aperture being milled into the first metal plate. Likewise, the second conductive metallic layer is a second metal plate with each of the second port, the plurality of interconnected second waveguide channels, and each second aperture and the window being milled into the second metal plate. Similarly, the adapter interface layer may be a third metal plate with each of the first waveguide adapter interface and second waveguide adapter interface being milled into the third metal plate. All such metal plates have the same (i.e., substantially the same) footprint as the PCB layers. This allows all layers to be stacked up into a package.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Figure 1:
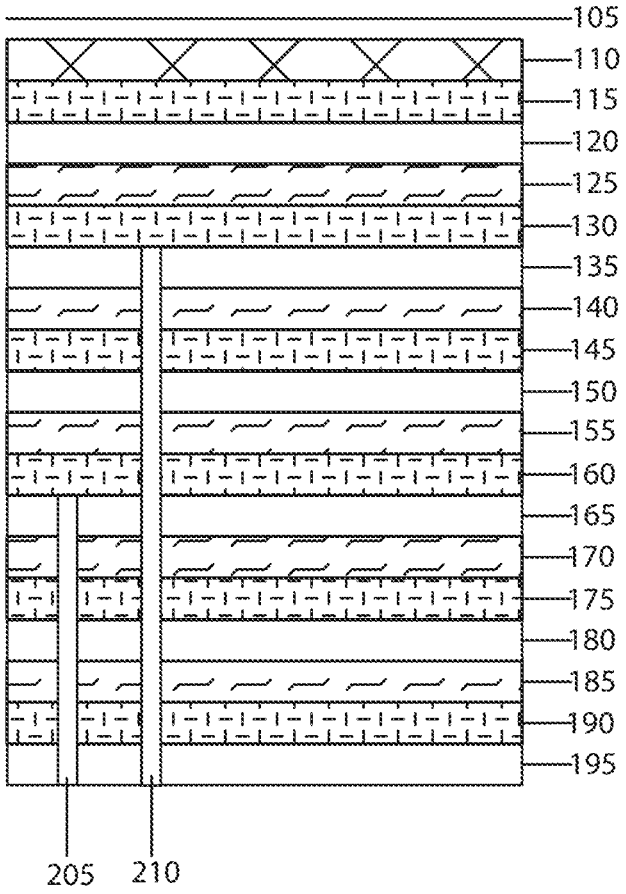
FIG. 1 conceptually illustrates a multilayer printed circuit board (PCB) stackup for an antenna array according to principles of the invention.

FIG. 1 conceptually illustrates a multilayer printed circuit board (PCB) stackup for an antenna array according to principles of the invention. The top layer 105 is a solder mask, a thin polymer coating applied to the copper traces of the printed circuit board (PCB) for protection against oxidation and to prevent solder bridges from forming between closely spaced solder pads. Several signal layers 120, 135, 150, 165, 180 and 195 are disposed below the top layer 105. The uppermost signal layer 120 includes an array of driven receive and transmit elements (e.g., patches) arranged in repeating patterns of unit cells, as described below. A parasitic layer 135 and a receive combiner layer 150 are provided beneath signal layer 120. Likewise, another parasitic layer 165 and a transmit combiner layer 180 are provided beneath the receive combiner layer 150. The combiner layers are discussed in greater detail below. A pair of dielectric layers 110, 115 is disposed between the top layer 105 and the uppermost signal layer 120. Likewise, pairs of dielectric electric layers 125, 130; 140, 145; 155, 160; 170, 175; 185, 190 are disposed between signal layers 120, 135, 150, 165, 180 and 195, respectively. These pairs of dielectric layers provide a suitable substrate upon which each signal layer is disposed and suitable bonding between signal layers.

Vias 205, 210 extend upwardly from the bottom layer 195 through signal layers 165 and 135 respectively. The vias 205, 210 are plated holes used to route electrical signals among different layers of the multilayer PCB assembly. The vias comprise conductive barrels, pads, and annular rings.

Figure 2:
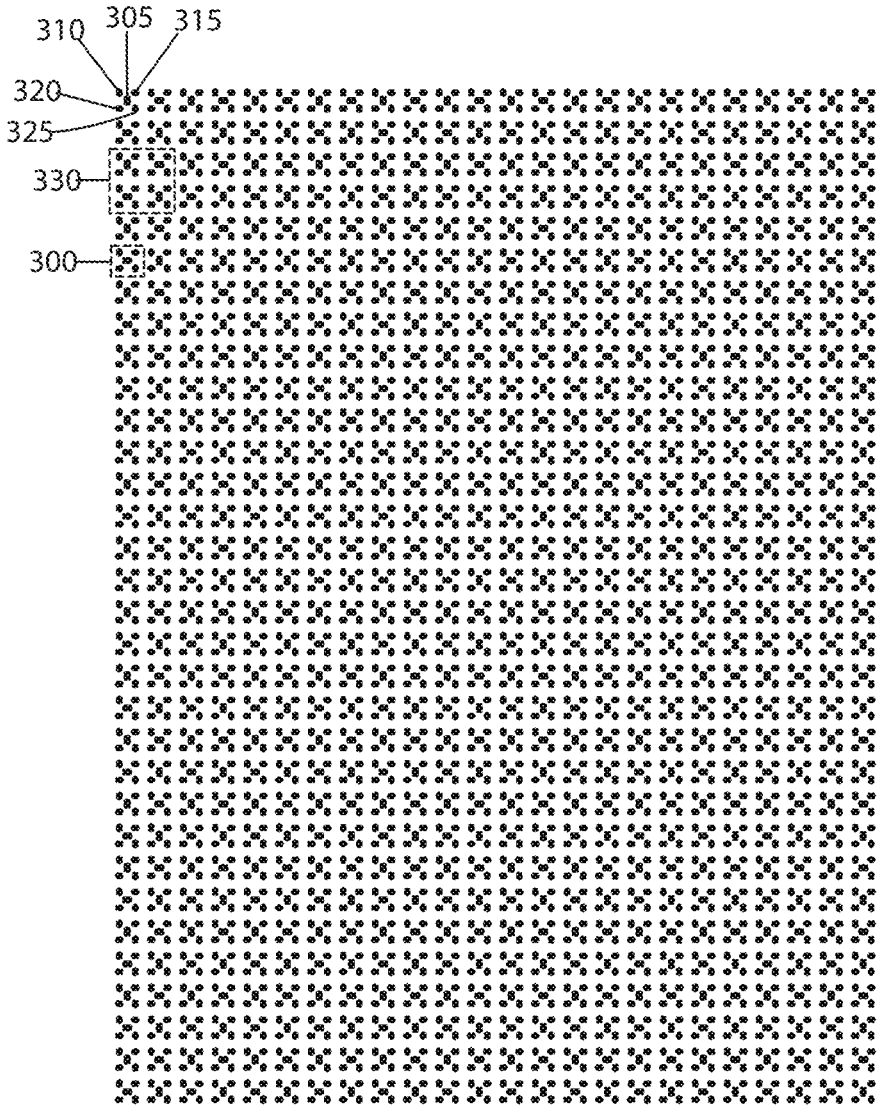
FIG. 2 conceptually illustrates an uppermost signal layer, which includes an array of driven receive and transmit elements (e.g., PCB patches), arranged in repeating patterns of unit cells. according to principles of the invention.

FIG. 2 conceptually illustrates the uppermost signal layer 120, which includes an array of driven receive and transmit elements (e.g., PCB patches), arranged in repeating patterns of unit cells. The exemplary array includes 24 rows and 24 columns of unit cells. However, the invention is scalable and not limited to the illustrated rows and columns.

In the exemplary embodiment shown in FIG. 2, each unit cell 300 includes a central receive patch 305 surrounded by four evenly spaced transmit patches 310, 315, 320, 325. Each transmit patch is evenly spaced from each adjacent transmit patch, i.e., each transmit patch of a unit cell in the same row or in the same column.

The unit cells of the array are evenly spaced apart. The space between unit cells, measured from center to center of aligned adjacent transmit patches, is equal to the space between aligned adjacent transmit patches of a unit cell.

Figure 3:
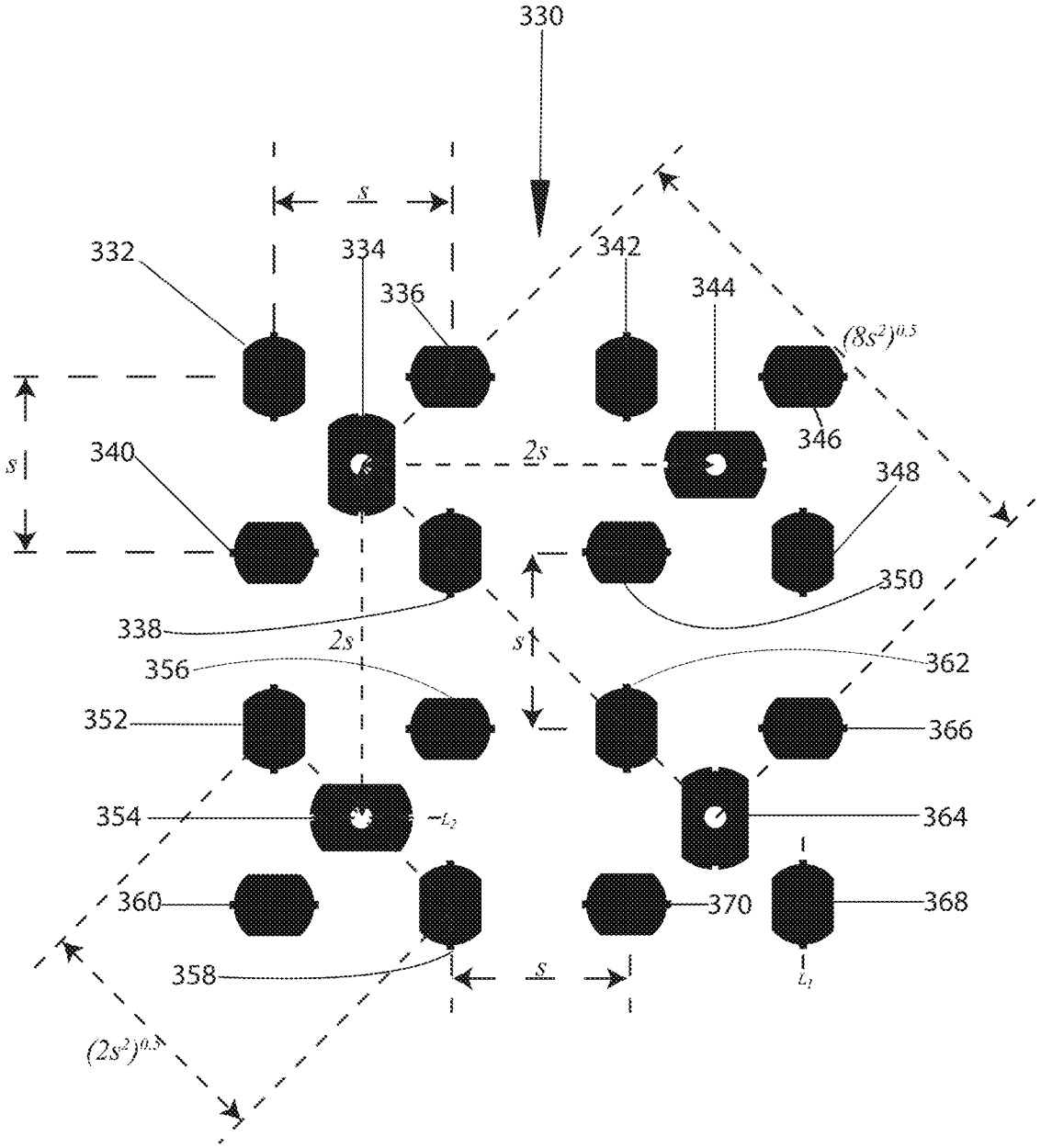
FIG. 3 conceptually illustrates a group of four unit cells of an antenna array according to principles of the invention.

With reference to FIG. 3, the centers of the transmit patches of a unit cell define corners of a square that has sides that extend to each center. The distance, s, (measured from center) between a transmit patch of a unit cell and each adjacent transmit patch of the unit cell is equal. Thus, the distance, s, (measured from centers) between adjacent transmit patches in the same row of a unit cell equals the distance between adjacent transmit patches in the same column of the unit cell. The distance, s, (measured from center) between a transmit patch of a unit cell and the opposite (non-adjacent) transmit patch (i.e., the transmit patch that is not in the same row or column) is $(2\ s^2)^{0.5}$.

Each transmit patch of a unit cell is also evenly spaced from the center of the receive patch 305 of the unit cell. A straight line extending from the center of a transmit patch to the center of a receive patch of the unit cell will be at an angle of 45° in relation to a line that extends through the center of the transmit patch and through the center of an adjacent transmit patch of the unit cell.

The spacing between adjacent like patches of adjacent unit cells is also equal. By way of illustration, the distance, from center to center, of a receive patch in a first unit cell and a receive patch in a unit cell in the same row but in the next or immediately preceding column of unit cells is equal to the distance, from center to center, of a receive patch in the first unit cell and a receive patch in a unit cell in the same column but in the next or immediately preceding row of unit cells. This distance equals 2 s. Adjacent aligned receive patches of an array are spaced apart by an equal distance, 2 s. Thus, the inter-cell spacings of aligned adjacent receive patches are equal.

Likewise, the distance, from center to center, of a transmit patch in a first row and first column of a first unit cell and a transmit patch in the second row and first column of a unit cell that is immediately above the first unit cell, equals s. The distance, from center to center, of a transmit patch in a first row and first column of a first unit cell and a transmit patch in the first row and second column of a unit cell that is immediately to the left of the first unit cell, also equals s. Adjacent aligned transmit patches of adjacent aligned unit cells of an array are spaced apart by an equal distance, s. Thus, the intra-cell and inter-cell spacings of aligned adjacent transmit patches are equal.

The spacings between adjacent aligned like patches (i.e., between adjacent aligned transmit patches and between adjacent aligned receive patches) are functionally significant. The spacings are sub-wavelength, meaning they are less than the wavelength at which the patch operates. The spacing between adjacent transmit patches, which may be measured from center to center of each adjacent aligned pair of transmit patches, is less than one wavelength ($\lambda$) for a radiated wave. Likewise, the spacing between adjacent receive patches 305, which may be measured from center to center of each adjacent aligned pair of receive patches, is less than one wavelength ($\lambda$) for a received wave.

Wavelength $\lambda$ may be computed from the frequency v and the speed of light c, an assumption being that the wave is traveling at the speed of light, which is the case for most wireless signals:

$$\lambda = \frac{c}{v}$$

Assuming, by way of illustration, a Ka-band uplink with a frequency in the range of 30 to 31 GHz, then the uplink wavelength is about 0.38 to 0.39 in. For downlink frequencies in the range of 20 to 21 GHz, the wavelength is about 0.56 to 0.59 in. Thus, the space, s, between adjacent aligned transmit patches is less than 0.38 mm and the spacing between adjacent aligned receive patches is less than 0.56 in.

Additionally, for the avoidance of grating lobes, a spacing between adjacent aligned receive patches that is about twice the spacing between adjacent aligned transmit patches is preferred. For example, if the spacing, s, between adjacent aligned transmit patches is 0.25 in, the spacing between adjacent aligned receive patches may be 0.5 in. In each case the spacing is sub-wavelength.

Four adjacent unit cells 330, which are grouped in FIG. 2, are shown in greater detail in FIG. 3. The upper-left most cell includes receive patch 334 and transmit patches 332, 336, 338, 340. The upper-right most cell includes receive patch 344 and transmit patches 342, 346, 348, 350. The lower-left most cell includes receive patch 354 and transmit patches 352, 356, 358, 360. The lower-right most cell includes receive patch 364 and transmit patches 362, 366, 368, 370.

The distances between like-kind adjacent aligned patches are the same within a cell and between adjacent cells, i.e., intra- and inter-cell. The distance between adjacent transmit matches is s. This distance applies for adjacent aligned transmit patches in the same row in a cell. It applies for adjacent transmit patches in the same column in a cell. It also applies for adjacent aligned transmit patches in aligned rows of two adjacent cells. It also applies for adjacent aligned transmit patches in aligned columns of two adjacent cells.

The distance between adjacent aligned receive patches of two adjacent cells is 2 s. This applies to adjacent aligned receive patches in the same column of an array. This also applies to adjacent aligned receive patches in the same row of an array.

All transmit patches share the same shape. The shape is generally oval with two axes of symmetry. Two opposite sides are curved (e.g., semicircular). The other two sides extending between the curved sides are straight. A small rectangular tab extends outwardly from the middle of each curved side. A longitudinal axis, L, bisects each tab. Each transmit patches is a conductive (e.g., copper) patch formed on a PCB. The length, measured from tab to tab, is less than the transmit wavelength, less than s, and preferably about s/2 (e.g., about 0.125 in). The width, measured from straight side to straight side, is about ⅔ the length (e.g., about 0.083 in).

All receive patches share the same shape. The shape is generally oval with two axes of symmetry. Two opposite sides are curved (e.g., semicircular). The other two sides extending between the curved sides are straight. A hole is provided at the center. A small rectangular indentation extends inwardly from the middle of each curved side. A longitudinal axis, $L_2$, bisects each indentation. Each transmit patches is a conductive (e.g., copper) patch formed on a PCB. Receive patches are slightly larger than transmit patches. The lengths and widths of the receive patch exceed those of the transmit patches by approximately 5 to 15%, for example, the length being about 0.144 in. and the width being about 0.094 in.

The patch lengths (measured along the longitudinal axes) do not exceed the shortest wavelength for uplink and downlink. Thus, for the exemplary Ka-band antenna array, the length of a receive patch and the length of a transmit patch is each less than the uplink wavelength. The length of a receive patch and the length of a transmit patch is each less than ½ of the uplink wavelength.

The orientations of transmit patches within a unit cell vary in 90° increments. Proceeding in sequence, such as a clockwise or counterclockwise sequence, starting from any transmit patch in a unit cell, the orientation of a transmit patch to each aligned adjacent transmit patch is different by 90°. For example, the transmit patch 332 at the top left of a unit cell is at a 90° different orientation than that of the transmit patch 336 at the top right of a unit cell. The transmit patch 336 at the top right of a unit cell is at a 90° different orientation than that of the transmit patch 338 at the bottom right of a unit cell. The transmit patch 338 at the bottom right of a unit cell is at a 90° different orientation than that of the transmit patch 340 at the bottom left of a unit cell. The same incremental sequence applies to transmit patches 342, 346, 348, 350; and to 352, 356, 358, 360; and to 362, 366, 368, 370; and so on. The transmit patch at the bottom left of a unit cell is at a 90° different orientation than that of the transmit patch at the top left of a unit cell. This progression of 90° differences in orientation is referred to herein as sequential 90° incremental rotations in orientation. Thus, the transmit cells of a unit cell are arranged with a sequential 90° incremental rotations in orientation.

Similarly, the orientations of receive patches among aligned adjacent unit cells vary in 90° increments. With reference to the 4×4 array of FIG. 3, proceeding in sequence, such as a clockwise or counterclockwise sequence, starting from any receive patch in the array of aligned adjacent unit cells, the orientation of a receive patch to each aligned adjacent receive patch is different by 90°. For example, the receive patch 334 in the top left unit cell is at a 90° different orientation than that of the receive patch 344 in the top right unit cell. The receive patch in the top right unit cell 344 is at a 90° different orientation than that of the receive patch 364 in the bottom right unit cell. The receive patch in the bottom right 364 unit cell is at a 90° different orientation than that of the receive patch 354 in the bottom left unit cell. The receive patch 354 in the bottom left unit cell is at a 90° different orientation than that of the receive patch 334 in the top left unit cell. This progression of 90° differences in orientation is referred to herein as sequential 90° incremental rotations in orientation. Thus, the receive cells of an array of adjacent aligned unit cells are arranged with a sequential 90° incremental rotations in orientation.

Figure 4:
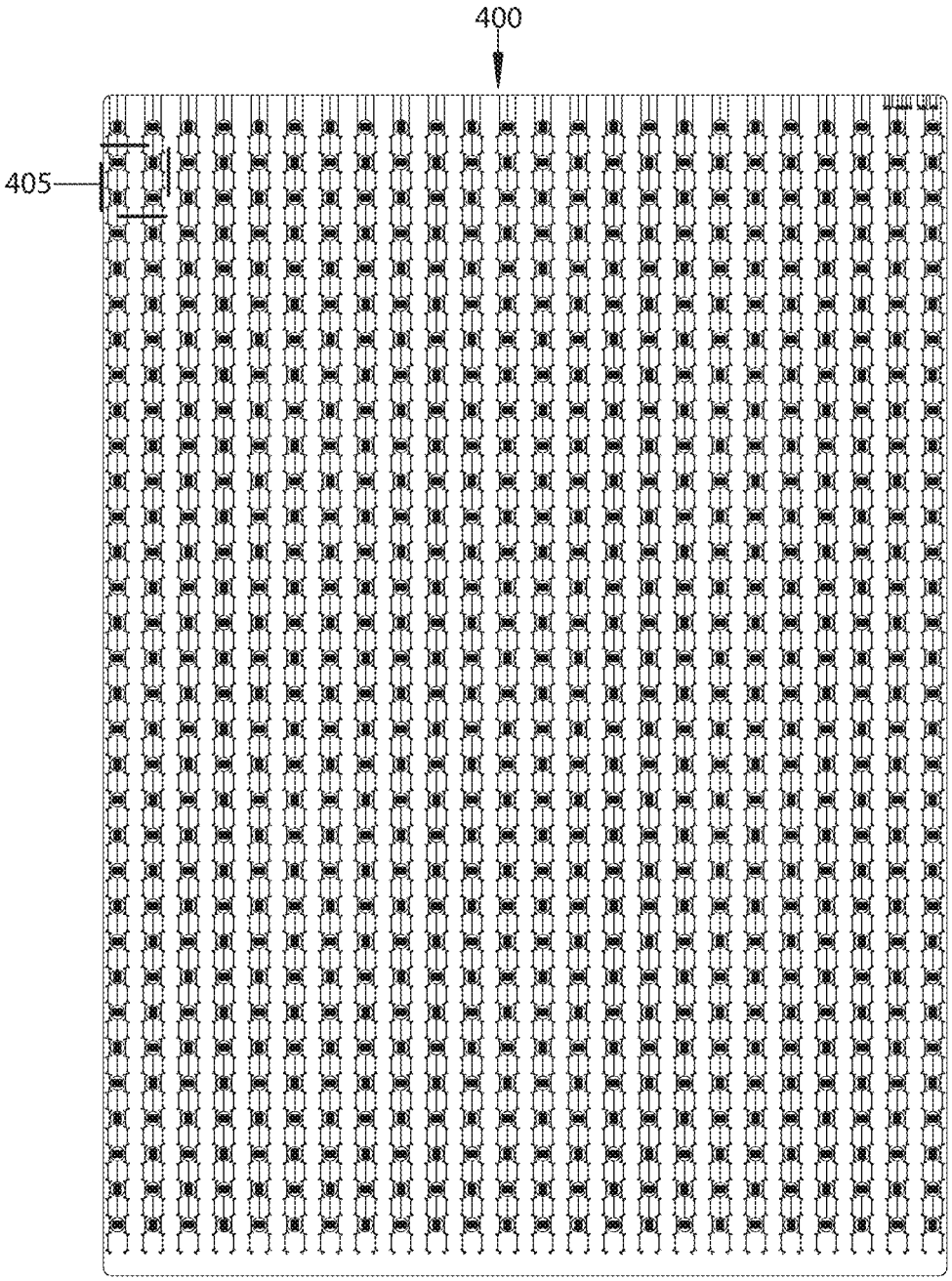
FIG. 4 conceptually illustrates a parasitic (open ground) layer of an antenna array according to principles of the invention.
Figure 5:
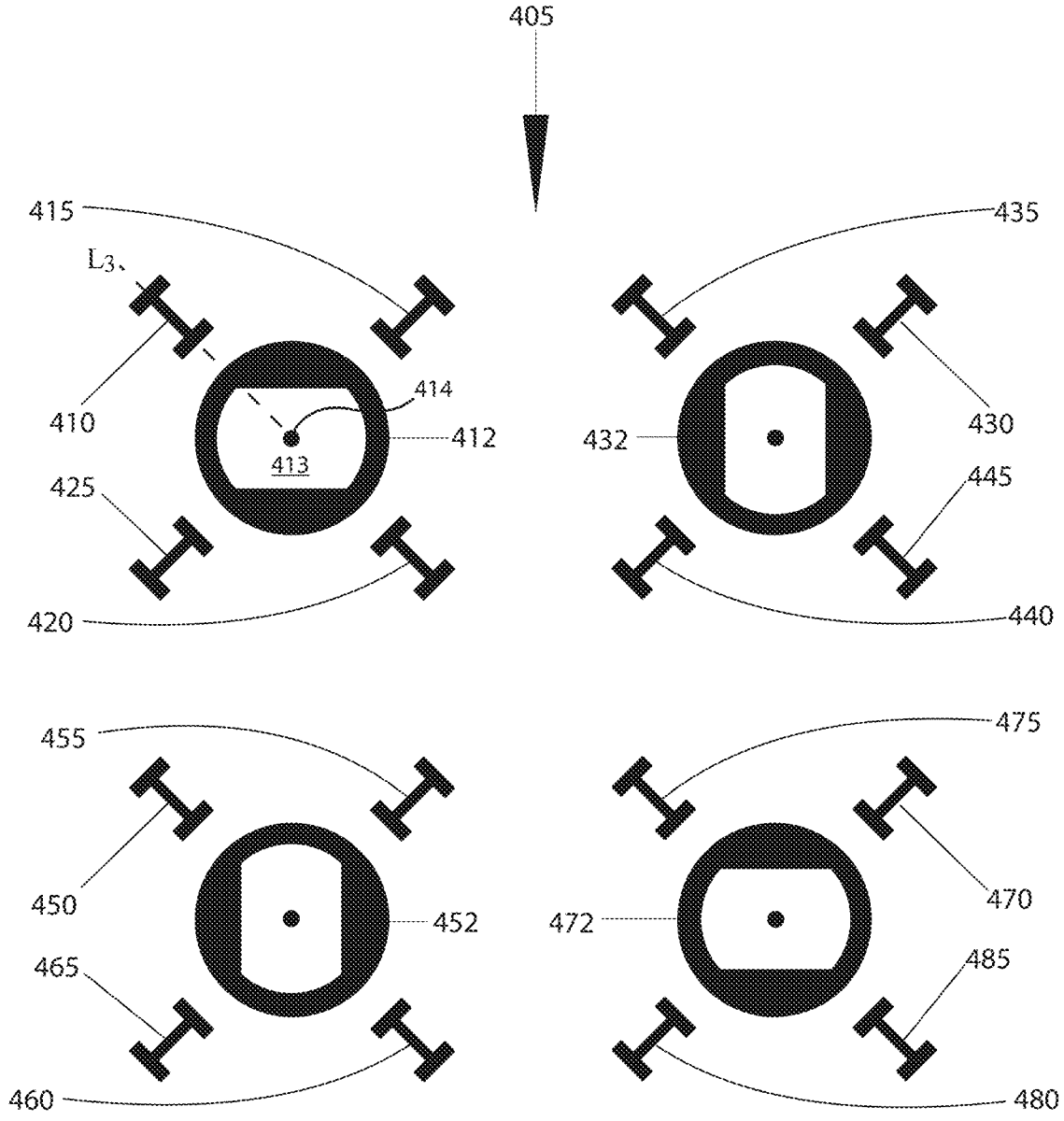
FIG. 5 conceptually illustrates elements of a parasitic layer of an antenna array according to principles of the invention.

FIG. 4 conceptually illustrates a parasitic (open ground) layer 400 of an antenna array according to principles of the invention. A 4×4 array 405 of elements is shown in FIG. 5. The parasitic layer underlies the layer illustrated in FIG. 2. The parasitic layer includes I shaped slots (holes), e.g., 410, 415, 420, 425, and 430, 435, 440, 445, and 450, 455, 460, 465 and 470, 475, 480, 485. Each I-shaped slot underlies a transmit patch of the layer illustrated in FIG. 2. The I-shaped slots are oriented with their longitudinal axis, $L_3$, in alignment with their associated center hole. The I-shaped slots surround their associated center hole. For example, I-shaped holes 410, 415, 420, 425 surround center hole 414 and have longitudinal axes $L_3$ aligned with center hole 414. Each I-shaped slot may be a hole (aperture) or an area devoid of conductive material. The length and width of each I-shaped slot is about the same as the length and width of a transmit patch, respectively.

Each cell in the array includes a center hole 414 at the center of a central patch 413. The central patch 413 underlies each receive patch of the layer illustrated in FIG. 2. Each central patch 413 is a conductive patch. The orientation of each central patch 413 is the same as the orientation of the receive patch in the driven layer (FIG. 2) above the parasitic layer 400. Each central patch 413 is disposed within a circular region 412, which is devoid of conductive material. Each center hole 414 may be a hole (aperture) or an area devoid of conductive material. While the central patch 413 and center hole 414 are designated for only circular region 412, for convenience of reference, each circular region 412, 432, 452 and 472 includes such a central patch and center hole.

Figure 6:
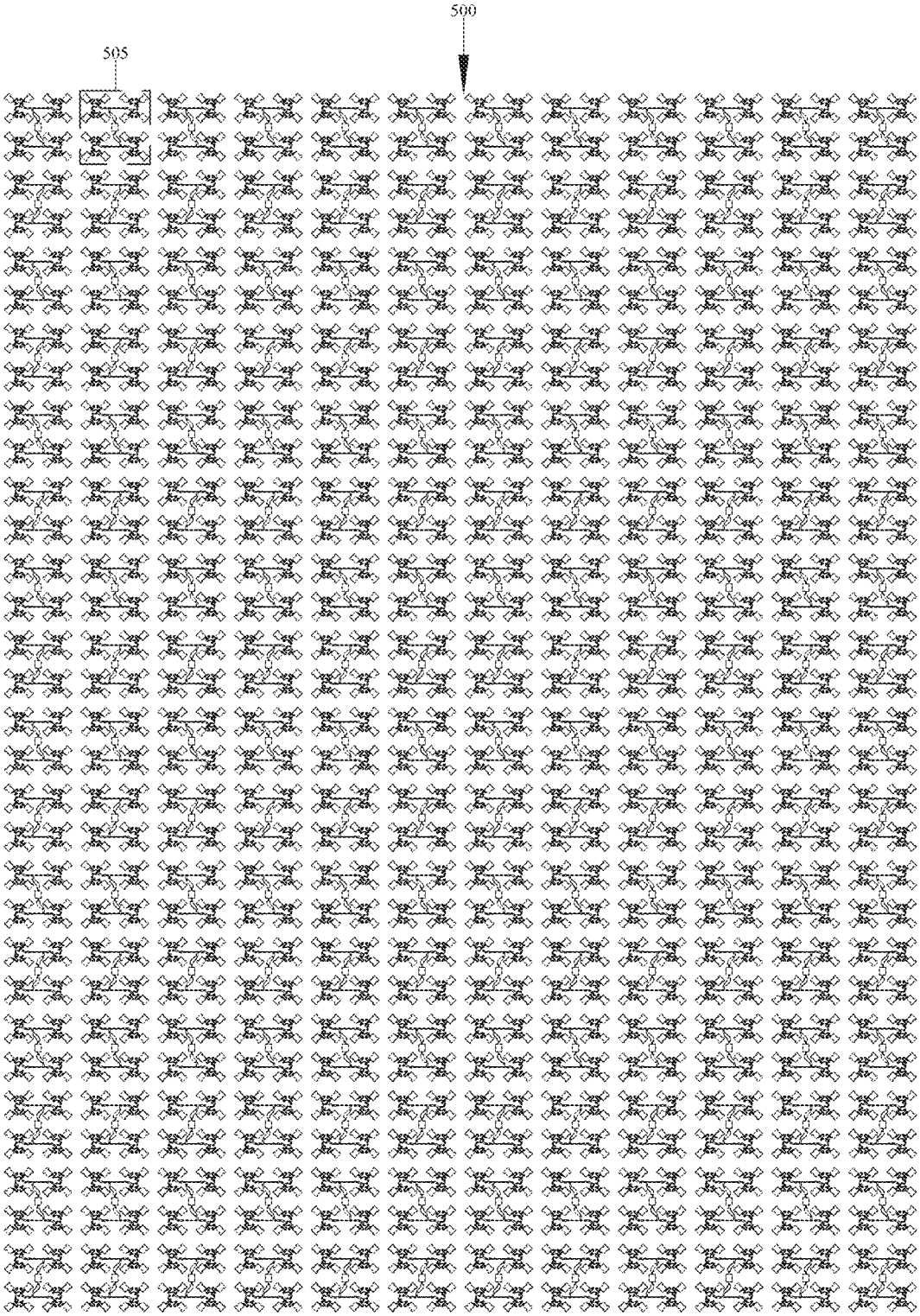
FIG. 6 conceptually illustrates a transmit combiner layer of an antenna array according to principles of the invention.
Figure 7:
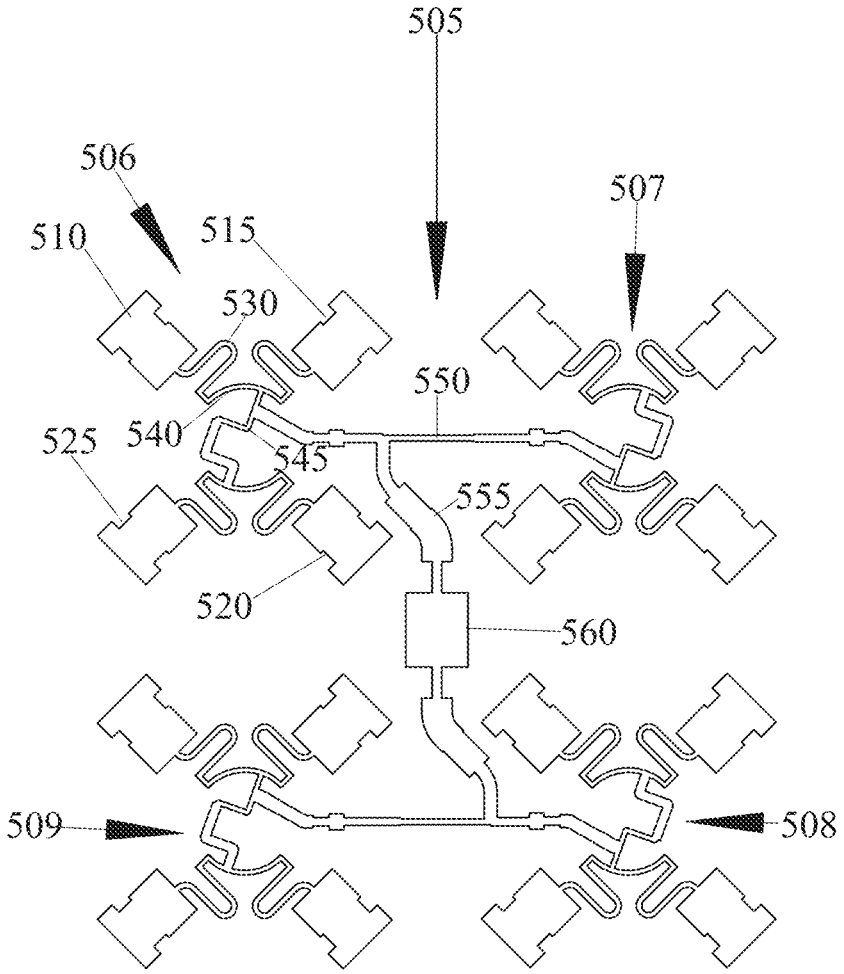
FIG. 7 conceptually illustrates elements of a transmit combiner layer of an antenna array according to principles of the invention.

FIG. 6 conceptually illustrates a transmit combiner layer 500 of an antenna array according to principles of the invention. This combiner layer 500 underlies the parasitic layer 400. A 4×4 group 505 of the combiner array layer 500 is shown in FIG. 7. The group 505 includes 4 cell combiners 506, 507, 508, 509 and a group combiner 560. Each cell combiner 506, 507, 508, 509 includes four conductive pads 510, 515, 520, 525 (aka, transmit combiner pads). Each transmit combiner pad 510, 515, 520, 525 is positioned for alignment with a transmit patch (e.g., transmit patch 332, 336, 338, 340). Each transmit combiner pad 510, 515, 520, 525 is conductively coupled to a transmit patch (e.g., transmit patch 332, 336, 338, 340). All transmit combiner pads for a cell are conductively coupled to a cell junction 545, via circular segments 540. The circular segments 540 underlie the circular region 412 of the parasitic layer 400. Each cell junction 545 is comprised of a narrow reticulate stripline, to avoid coupling with receive patches. A conductive branch 550 connects each cell combiner in the same row of the 4×4 group. Instead of running horizontal, the branch 550 could run vertical to instead connect each cell combiner in the same column of the 4×4 group, without departing from the scope of the invention. A conductive trunk 555 extends from the middle of each branch 550 to a central group combiner 560. The group combiner 560 is another conductive pad. Thus, one group combiner 560 conductively combines 16 transmit combiner pads, including four transmit combiner pads 510, 515, 520, 525 from each of four cell combiners 506, 507, 508, 509. As discussed below, a transmit waveguide communicatively couples to each group combiner 560 of the transmit combiner layer 500.

In sum, the transmit combiner layer 500 conductively combines a plurality of transmit combiner pads 510, 515, 520, 525 for each cell and for a group of cells. Using these principles, it is possible to conductively combine more or less than four cell combiners 506, 507, 508, 509, and even multiple groups together, without departing from the scope of the invention. The combination enables coupling the combiners 560 to a machined waveguide that has a footprint that is about the same as the footprint of the layered PCB structure.

Figure 8:
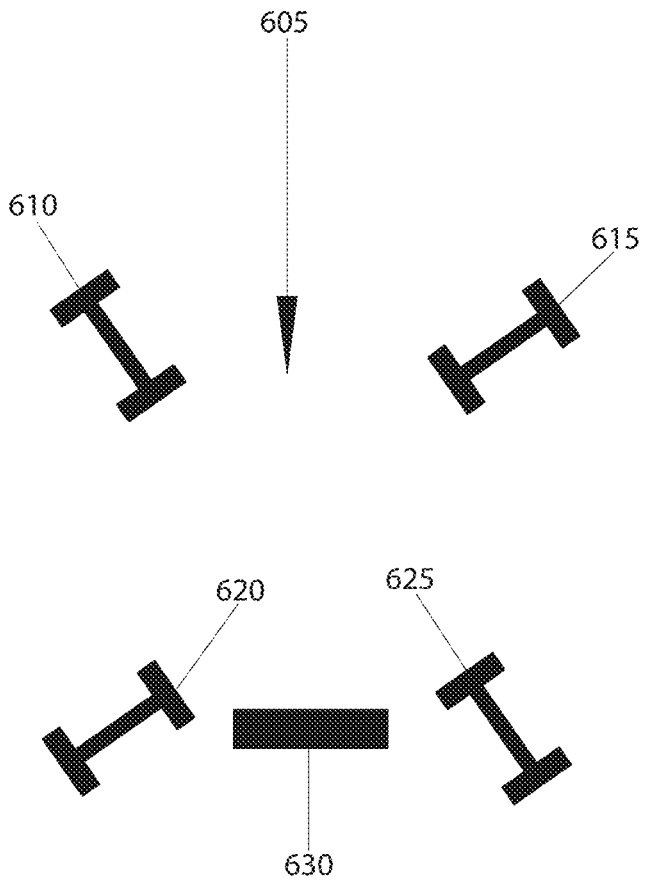
FIG. 8 conceptually illustrates slots for alignment to portions of the transmit combiner layer and portions of the parasitic layer of an antenna array according to principles of the invention.
Figure 9:
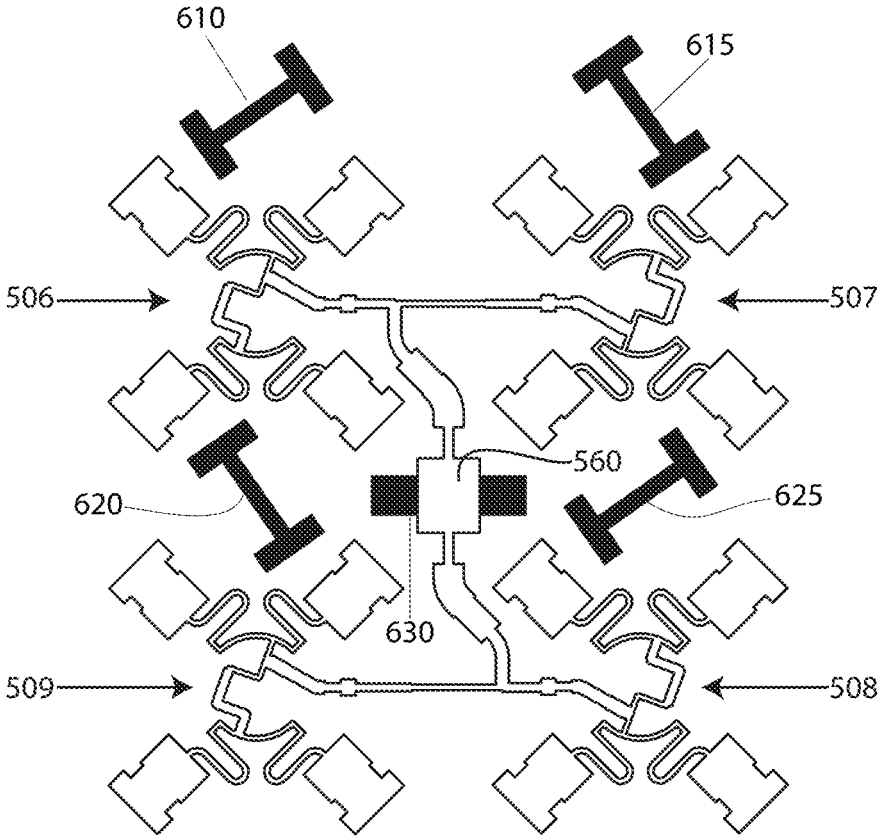
FIG. 9 conceptually illustrates slots aligned to portions of the transmit combiner layer of an antenna array according to principles of the invention.

FIG. 8 conceptually illustrates slots 610, 615, 620, 625 and 630 which align to portions of the transmit combiner layer and to portions of the parasitic layer of an antenna array according to principles of the invention. A layer comprising an array of such slots underlies the transmit combiner layer. FIG. 9 conceptually illustrates alignment to portions of the transmit combiner layer. Rectangular slot 630 (hole) aligns to group combiner 560. I-shaped slots 610, 615, 620 and 625 align to central patches 413 of the parasitic layer. The pattern of slots shown in FIG. 8 repeats in an array, with sufficient slots to align to every central patch of the parasitic layer and every group combiner 560 of the transmit combiner layer.

Figure 10:
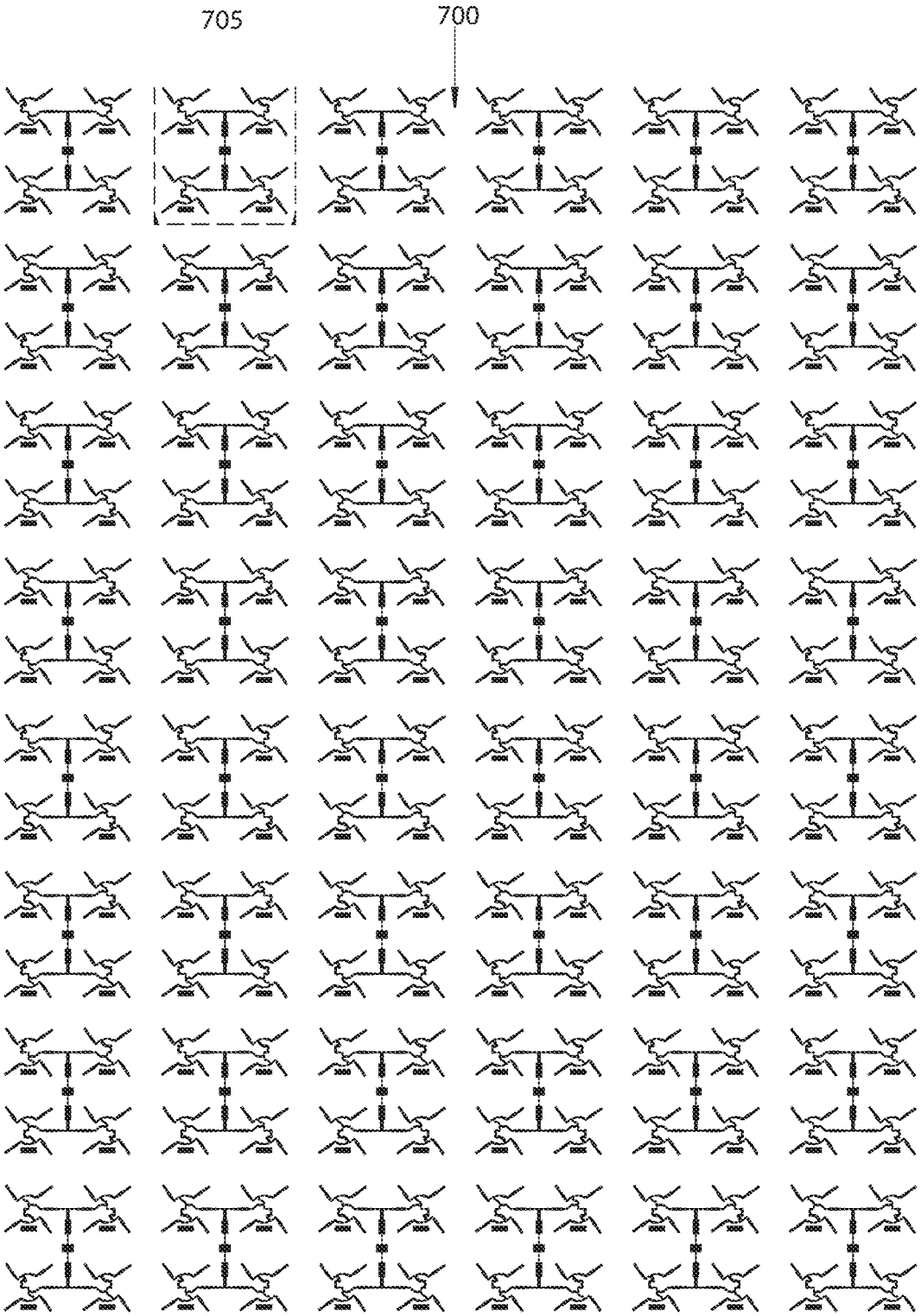
FIG. 10 conceptually illustrates a receive combiner layer of an antenna array according to principles of the invention.
Figure 11:
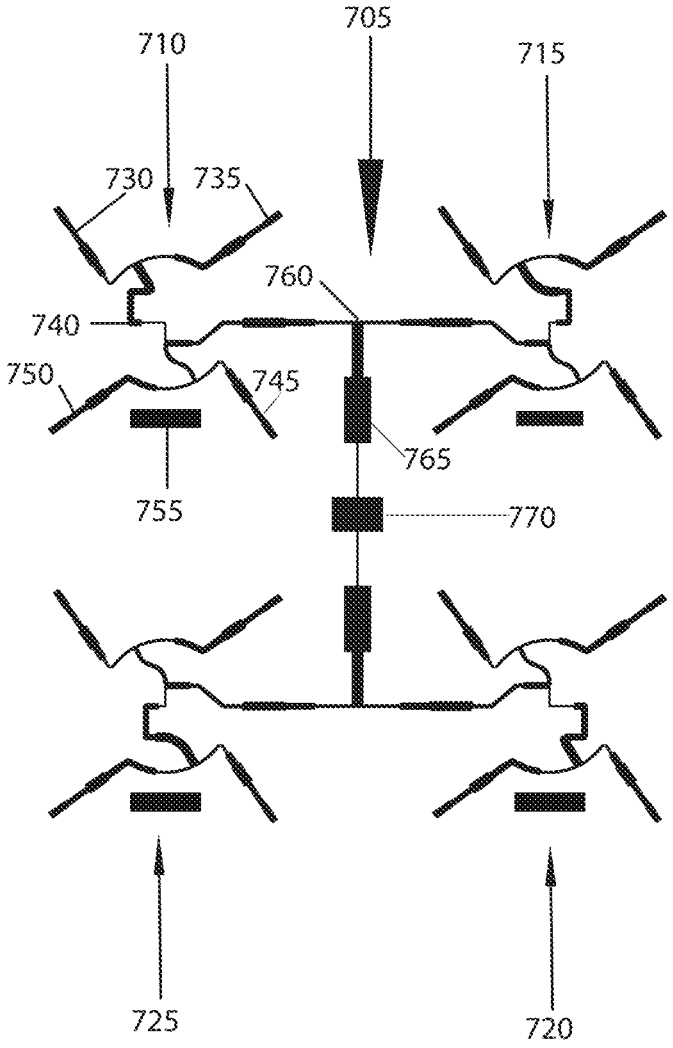
FIG. 11 conceptually illustrates elements of a receive combiner layer of an antenna array according to principles of the invention.
Figure 12:
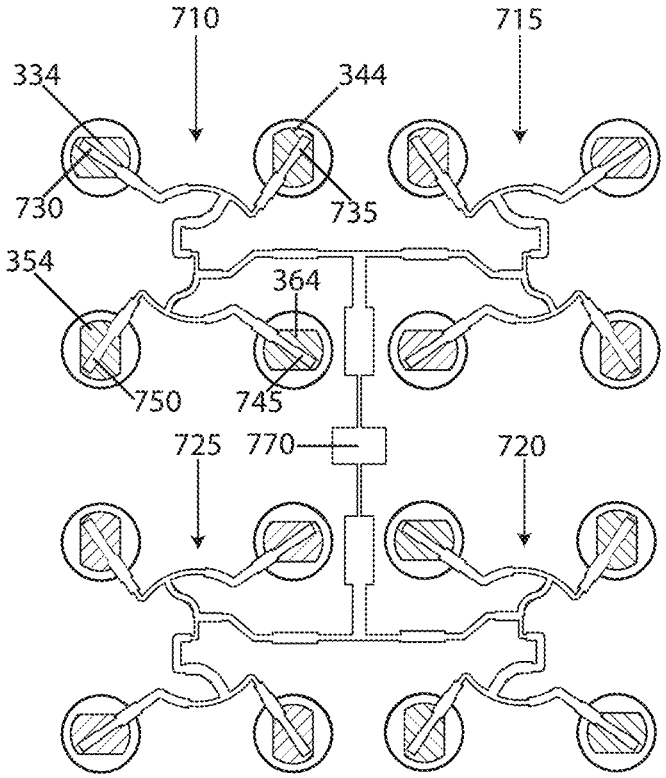
FIG. 12 conceptually illustrates a layer with holes aligned for communication with receive and transmit combiners of an antenna array according to principles of the invention.

FIG. 10 conceptually illustrates a receive combiner layer 700 of an antenna array according to principles of the invention. This combiner layer 700 underlies the parasitic layer 400. A 4×4 group 705 of the combiner array layer 700 is shown in FIG. 11. The group 705 includes 4 cell combiners 710, 715, 720, 725 and a group combiner 770. Each cell combiner 710, 715, 720, 725 includes four conductive spoke-like strip lines 730, 735, 745, 750 (aka, receive combiner lines). Each receive combiner line 730, 735, 745, 750 is positioned for alignment with a receive patch (e.g., receive patch 334, 344, 354, 364, via pads 413), as conceptually illustrated in FIG. 12. Each receive combiner line 730, 735, 745, 750 is conductively coupled to a receive patch (e.g., receive patch 334, 344, 354, 364). All receive combiner lines for a cell are conductively coupled to a cell junction 740. The receive combiner lines 730, 735, 745, 750 extend radially from the junction. Each cell junction 740 is comprised of a narrow reticulate stripline, that avoid coupling with transmit patches. A conductive branch 760 connects each cell combiner in the same row of the 4×4 group. Instead of running horizontal, the branch 760 could run vertical to instead connect each cell combiner in the same column of the 4×4 group, without departing from the scope of the invention. A conductive trunk 765 extends from the middle of each branch 760 to a central group combiner 770. The group combiner 770 is a conductive pad. Thus, one group combiner 770 conductively combines 16 receive combiner lines, including four receive combiner lines 730, 735, 745, 750 from each of four cell combiners 710, 715, 720, 725. As discussed below, a receive waveguide communicatively couples to each group combiner 770 of the receive combiner layer 700.

Each cell combiner also includes a hole 755 for alignment with a group combiner 560 of the transmit combiner layer 500. The hole provides an aperture through which a transmit waveguide may couple with each group combiner of the transmit combiner layer.

In sum, the receive combiner layer 700 conductively combines a plurality of receive combiner lines 730, 735, 745, 750 for each cell and for a group of cells. Using these principles, it is possible to conductively combine more or less than four cell combiners 710, 715, 720, 725, and even multiple groups together, without departing from the scope of the invention. The combination enables coupling the combiners 770 to a machined waveguide that has a footprint that is about the same as the footprint of the layered PCB structure.

Figure 13:
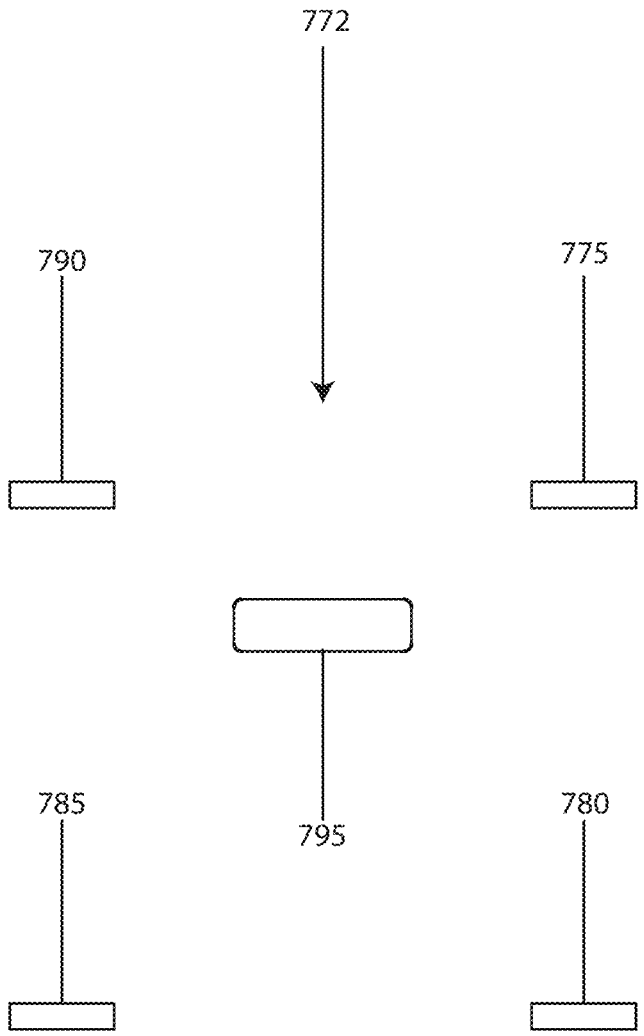
FIG. 13 conceptually illustrates a layer with holes for a receive combiner layer of an antenna array according to principles of the invention.
Figure 14:
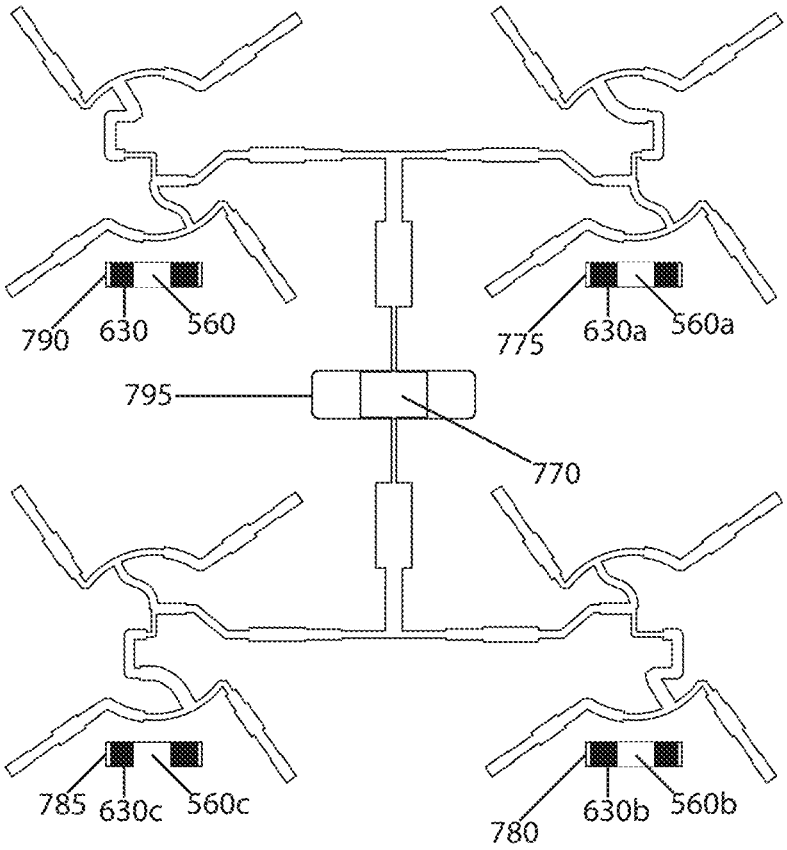
FIG. 14 conceptually illustrates a layer with holes aligned for communication with receive combiners of an antenna array according to principles of the invention.
Figure 15:
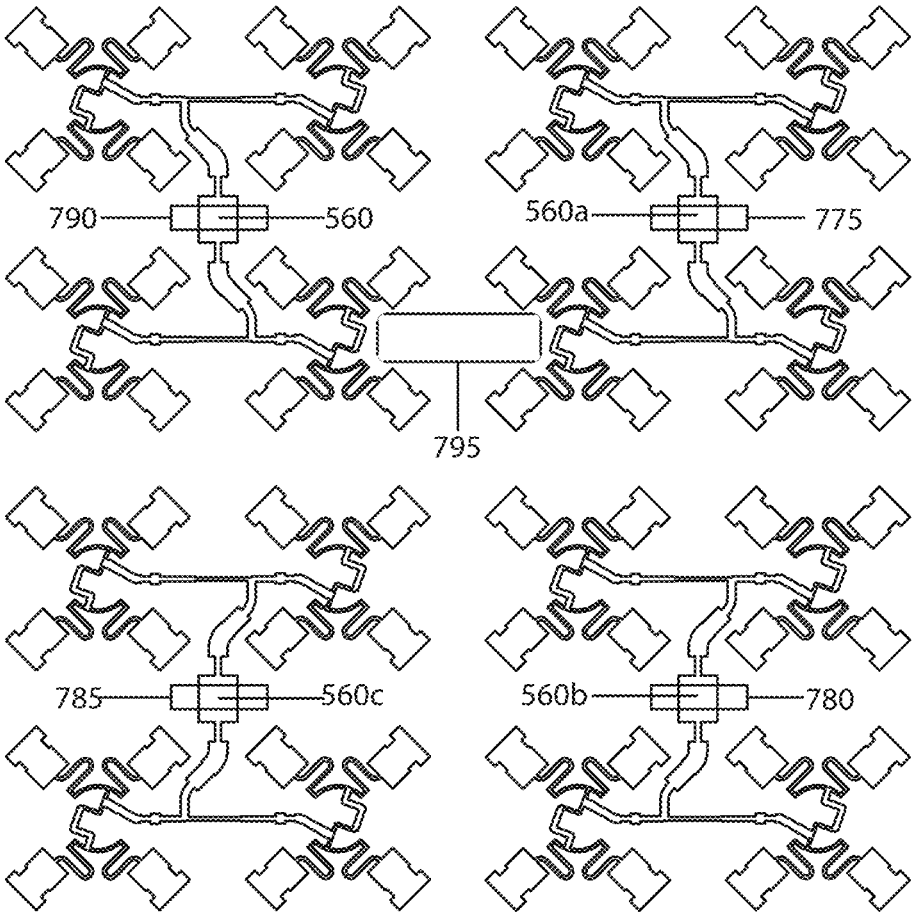
FIG. 15 conceptually illustrates a layer with holes aligned for communication with transmit combiners of an antenna array according to principles of the invention.

FIG. 13 conceptually illustrates a group of holes 772 for a layer with holes (i.e., slots) aligned for communication with receive and transmit combiners of an antenna array according to principles of the invention. A group 772, as shown in FIG. 13, is provided for and positioned beneath each receive group combiner 770 and each transmit group combiner 560. Rectangular holes 775, 780, 785, 790 align with each transmit group combiner 560. Larger central rectangular hole 795 aligns with each receive group combiner 770. The alignments are conceptually illustrated in FIG. 14 for a receive combiner, and in FIG. 15 for a transmit combiner, with 560, 560*a*, 560*b*, and 560*c* each representing a transmit group combiner, and 630, 630*a*, 630*b*, and 630*c* representing rectangular slots (holes) aligned with transmit group combiners 560, as conceptually illustrated in FIG. 9 as 630. These holes provide separate distinct apertures through which a transmit waveguide may couple with each group combiner of the transmit combiner layer and through which a receive waveguide may couple with each group combiner of the receive combiner layer.

Figure 16:
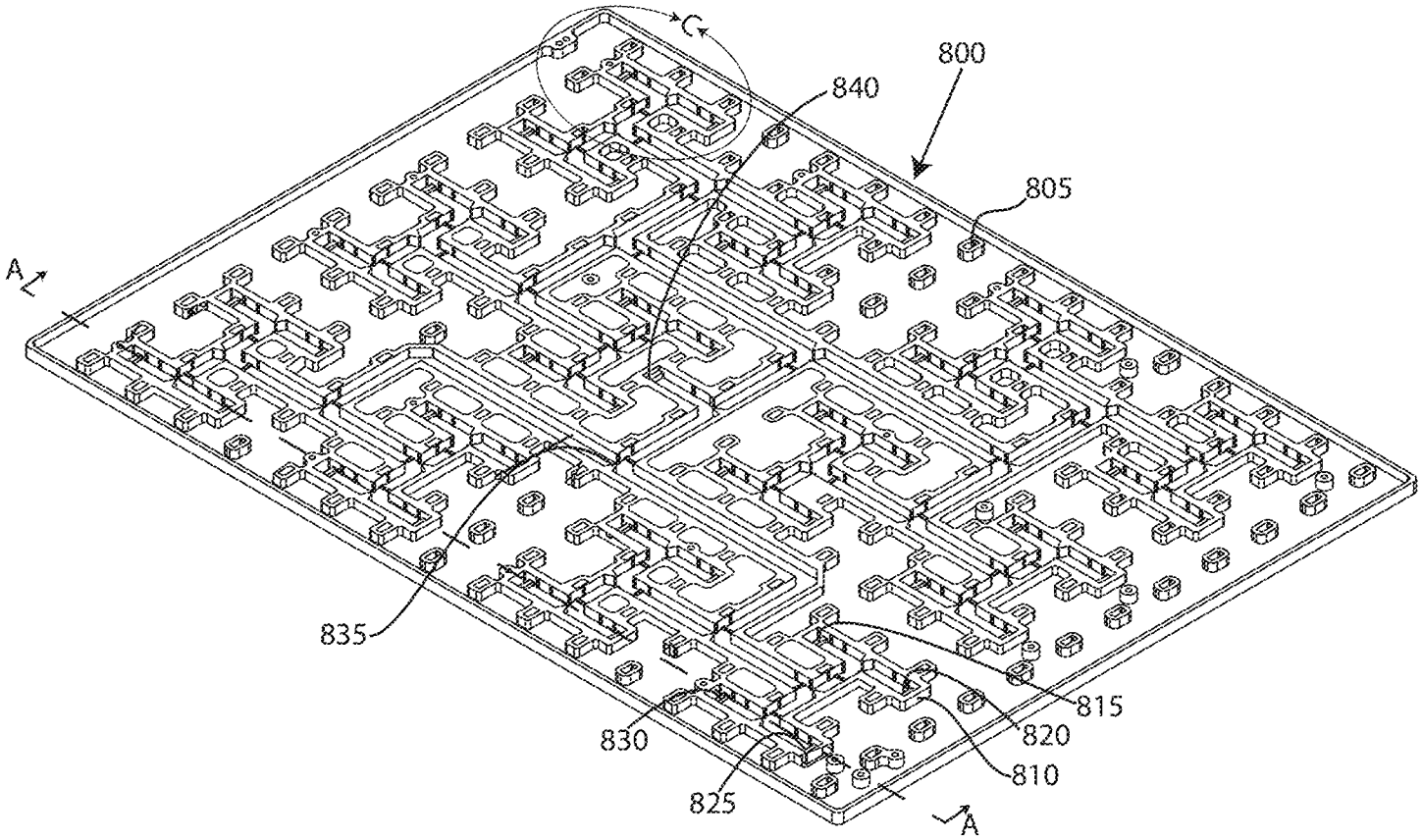
FIG. 16 conceptually illustrates a first waveguide layer according to principles of the invention.

FIG. 16 conceptually illustrates a receive waveguide layer 800 according to principles of the invention. In an exemplary implementation, the waveguide is machined into a conductive metal plate, such as a silver plated 6061 aluminum alloy plate having a thickness of approximately 0.21 inches. The waveguide is generally a network of rectangular waveguide channels, with features that couple with each receive group combiner. The waveguide includes a plurality of interconnected I-shaped channel groups, such as I-shaped channel group 810. The I-shaped channel group includes two parallel spaced apart channel segments, the ends 815, 820, 825, 830 of which couple with receive group combiners. Each end includes a step 825, 830 or ridge followed by an aperture 827, 832 (FIGS. 17 and 18) to couple a wave with a receive group combiner. The step 825, 830 or ridge followed by an aperture 827, 832 enables coupling without any direct conductive connection from the aperture to the coupled group combiner. The aperture and step extend from sidewall to sidewall. Thus, each I-shaped channel group 810 couples to four receive group combiners. A plurality of channels interconnect all I-shaped channel groups. Waves are directed through the channels with wedge shaped projections 835 from sidewalls. Thus, the receive waveguide caries high frequency radio waves, particularly microwaves, from receive group combiners through the waveguide to a stepped outlet 840.

Figure 17:
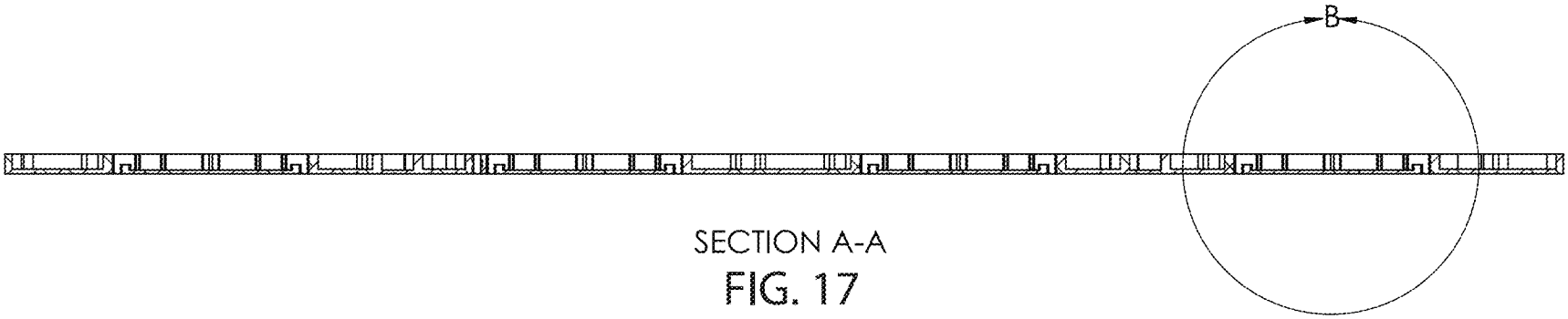
FIGS. 17-20 provide section and detail views of portions of the first waveguide layer according to principles of the invention.
Figure 18:
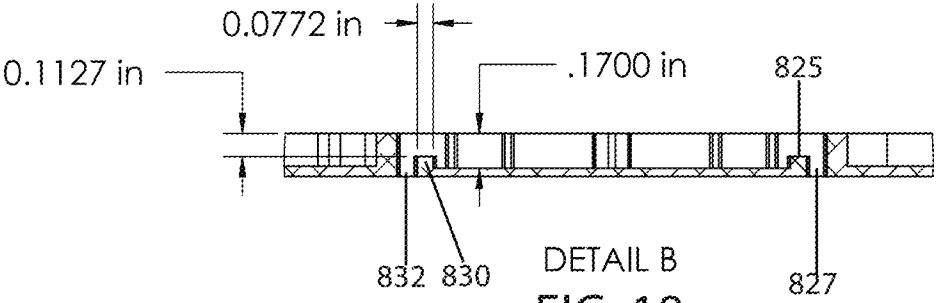

As shown in FIGS. 17 and 18, in the exemplary implementation, the depth of each channel is about 0.17 in. The width of each channel is approximately 0.34 in., which is less than one wavelength. The depth of each channel being approximately 0.17 in. is about half the channel width, and less than ½ wavelength. The height of each step is about 0.0573 in. The run of each step is about 0.0772 in. The run of each aperture is no greater than, and preferably less than the run of the step. Each wedge extends from the sidewall to about the middle of channel.

Figure 19:
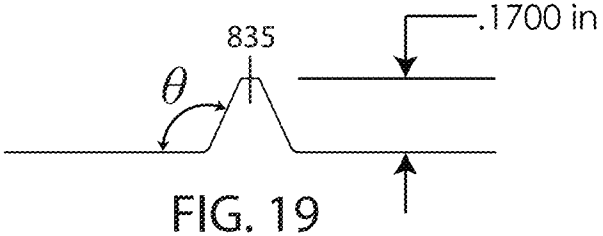

As shown in the exemplary embodiment of FIG. 19, the wedge is symmetrical. Angle θ is about 115°. Thus, the acute angle between the oblique sides of the wedge that extend from the sidewall to the planar free end is about 50°. The free end of the wedge 835 is planar and parallel to the sidewall.

A plurality of holes 805 are provided to allow coupling between a transmit waveguide below the receive waveguide and the transmit combiner. As more clearly shown in FIG. 20, each such hole 805*a*, 805*b* is a ridged waveguide with a central ridge 806*a*, 806*b* that extends from a sidewall to the middle of the waveguide.

Figure 20:
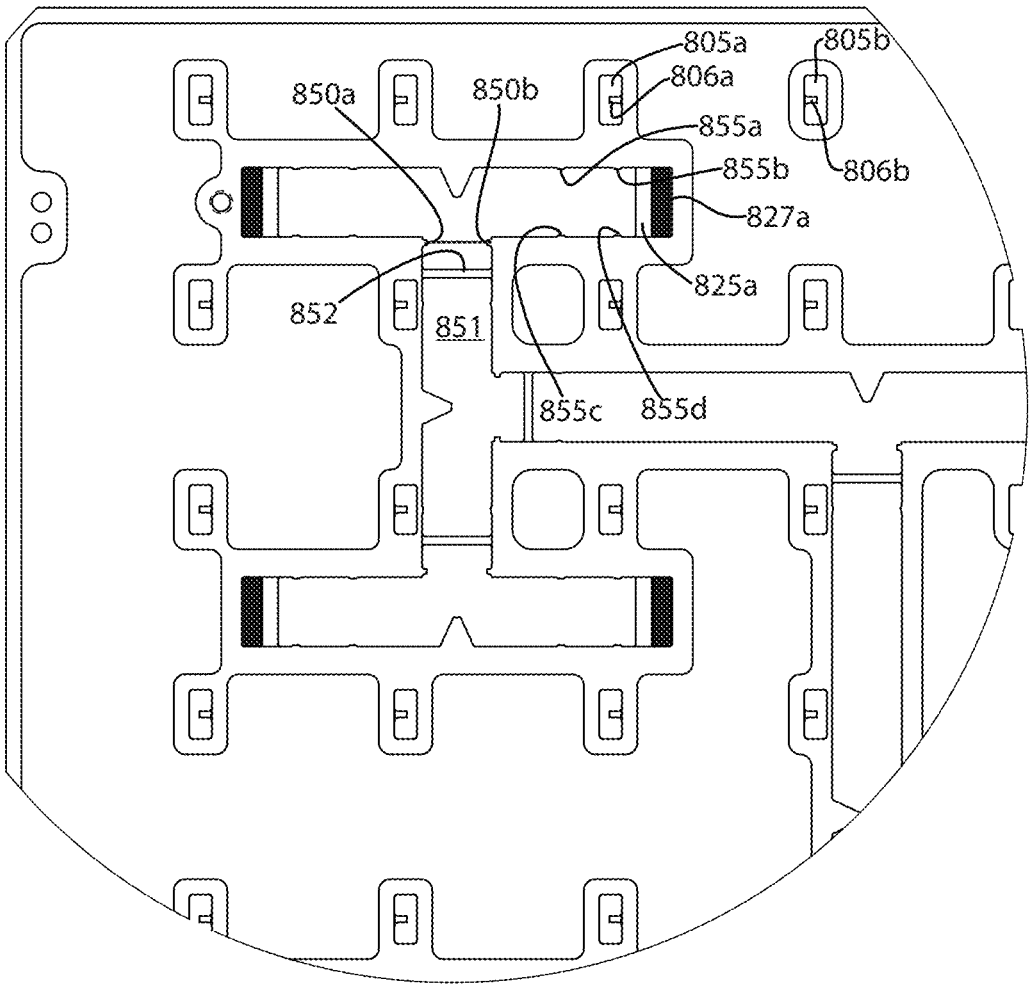

Referring to FIG. 20, each wedge 835*a* is positioned opposite an intersection of channels. The wedge 835*a* guides a wave through the intersection. A channel 851 extends opposite the wedge 835. A pair of opposed ribs 850*a*, 850*b* extend inwardly (towards the middle of the channel 851) adjacent to the intersection, to focus a wave. The ribs 850*a*, 850*b* extend inwardly towards the middle of the channel by approximately 5 to 10% of the width of the channel 851. Corners from the sidewall to the ribs 850*a*, 850*b* are filleted. Two opposed pairs of ribs 855*a*, 855*b*, 855*c*, 855*d* extend from sidewalls of each channel adjacent to each step 825*a* and aperture 827*a*. The apertures are shown in black in FIG. 20 for eased of reference. The two opposed pairs of ribs 855*a*, 855*b*, 855*c*, 855*d* extend inwardly towards the middle of the channel less than ribs 850*a*, 850*b*. A shallow step 852 extends from sidewall to sidewall adjacent to ribs 850*a*, 850*b*. The number, spacing, sizes and locations of steps and ribs may be varied without departing from the scope of the invention.

Figure 21:
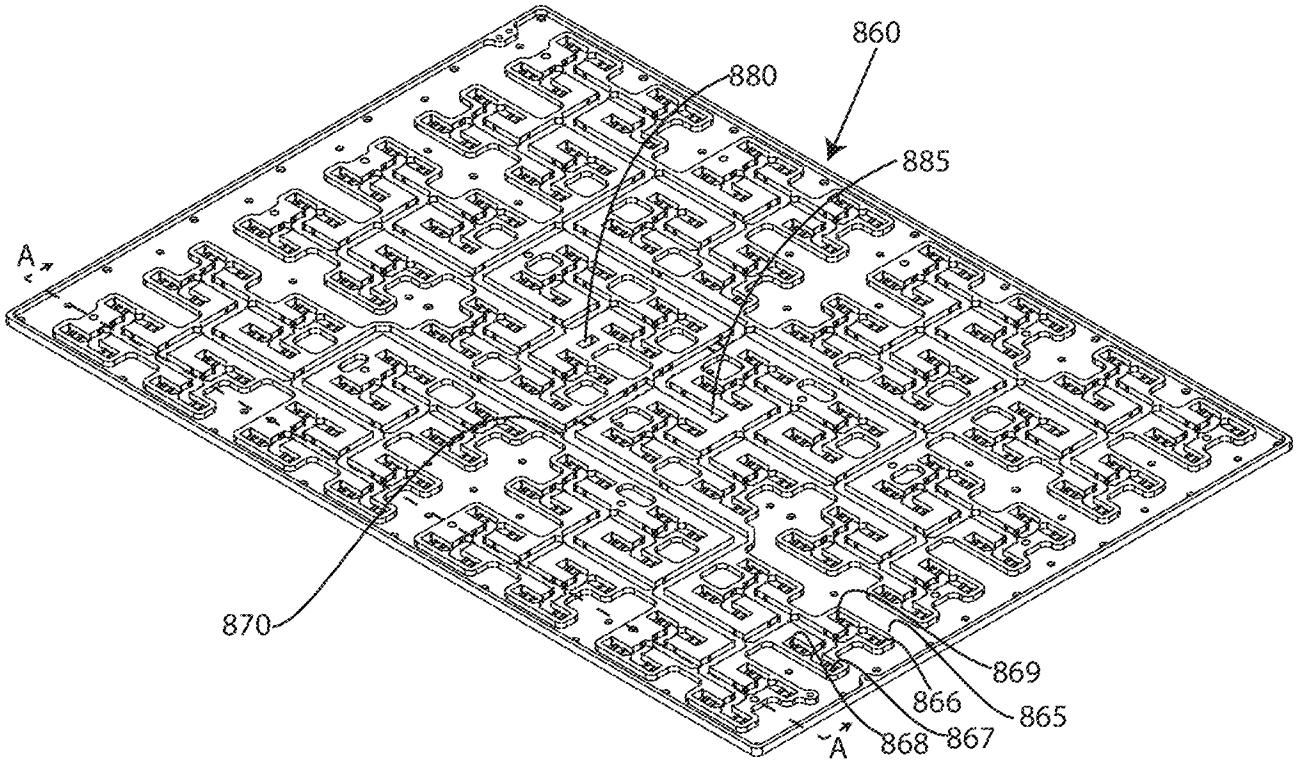
FIG. 21 conceptually illustrates a second waveguide layer according to principles of the invention.
Figure 22:
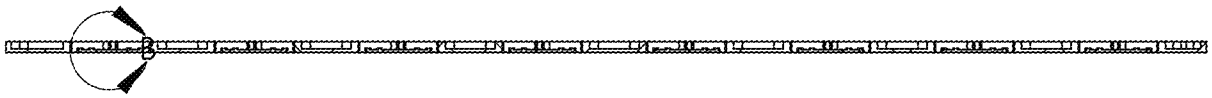
FIGS. 22-23 provide section and detail views of portions of the second waveguide layer according to principles of the invention.

FIG. 21 conceptually illustrates a transmit waveguide layer according to principles of the invention. FIG. 21 conceptually illustrates a transmit waveguide layer 860 according to principles of the invention. In an exemplary implementation, the waveguide is machined into a conductive metal plate, such as a silver plated 6061 aluminum alloy plate having a thickness of approximately 0.15 inches. The waveguide is generally a network of rectangular waveguide channels, with features that couple with each transmit group combiner. The waveguide includes a plurality of interconnected I-shaped channel groups, such as I-shaped channel group 865. The I-shaped channel group includes two parallel spaced apart channel segments, the ends 866, 867, 868, 869 of which couple with transmit group combiners. Each end includes a pair of spaced apart steps 890, 892 or ridges followed by an aperture 894 (FIGS. 22 and 23—dimensions in inches) to couple a wave with a transmit group combiner. The steps 890, 892 followed by an aperture 894 enables coupling without any direct conductive connection from the aperture to the coupled group combiner. The aperture and step extend from sidewall to sidewall. Thus, each I-shaped channel group 865 couples to four transmit group combiners. A plurality of channels interconnect all I-shaped channel groups. Waves are directed through the channels with wedge shaped projections 870 from sidewalls. Thus, the transmit waveguide caries high frequency radio waves, particularly microwaves, from transmit group combiners through the waveguide to a stepped aperture 894.

Figure 23:
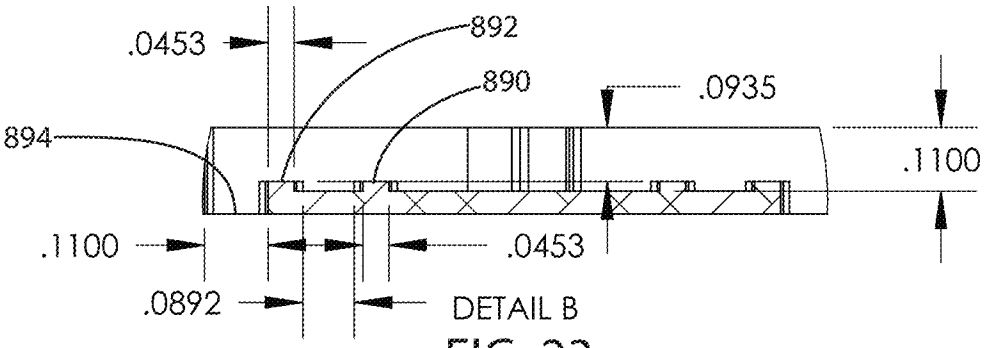

As shown in FIG. 23, in the exemplary implementation, the depth of each channel is about 0.11 in. The width of each channel is approximately 0.22 in., which is less than one wavelength. The depth of each channel being approximately 0.11 in. is about half the channel width, and less than ½ wavelength. The height of each step is about 0.0165 in.

Each wedge extends from the sidewall to about the middle of channel. The angles of the wedge 870 are the same as the angles of the wedge 835 for the receive waveguide, as shown in the exemplary embodiment of FIG. 19. The wedge is symmetrical. Angle θ is about 115°. Thus, the acute angle between the oblique sides of the wedge that extend from the sidewall to the planar free end is about 50°. The free end of the wedge 870 is planar and parallel to the sidewall.

Each aperture 894 aligns with one of the plurality of holes 805 in the receive waveguide 800 that are provided to allow coupling between the transmit waveguide 860 below the receive waveguide 800 and the transmit combiner.

An aperture 880 aligns with the outlet 840 of the receive waveguide 800. Waves from the receive waveguide may pass through the outlet 840 and through the aperture 880 to a terminal waveguide layer, as described below.

An inlet 885 aperture is provided in a channel. Input waves enter the waveguide 860 through the inlet 885. The waveguide 860 directs input (transmit) waves to the ends of each interconnected I-shaped channel group for coupling, without any direct conductive connection, from the aperture 894 to each coupled transmit group combiner.

While the receive waveguide is above the transmit waveguide in the exemplary implementation, the order is not so limited. The transmit waveguide may be disposed above the receive waveguide without departing from the scope of the invention.

Figure 24:
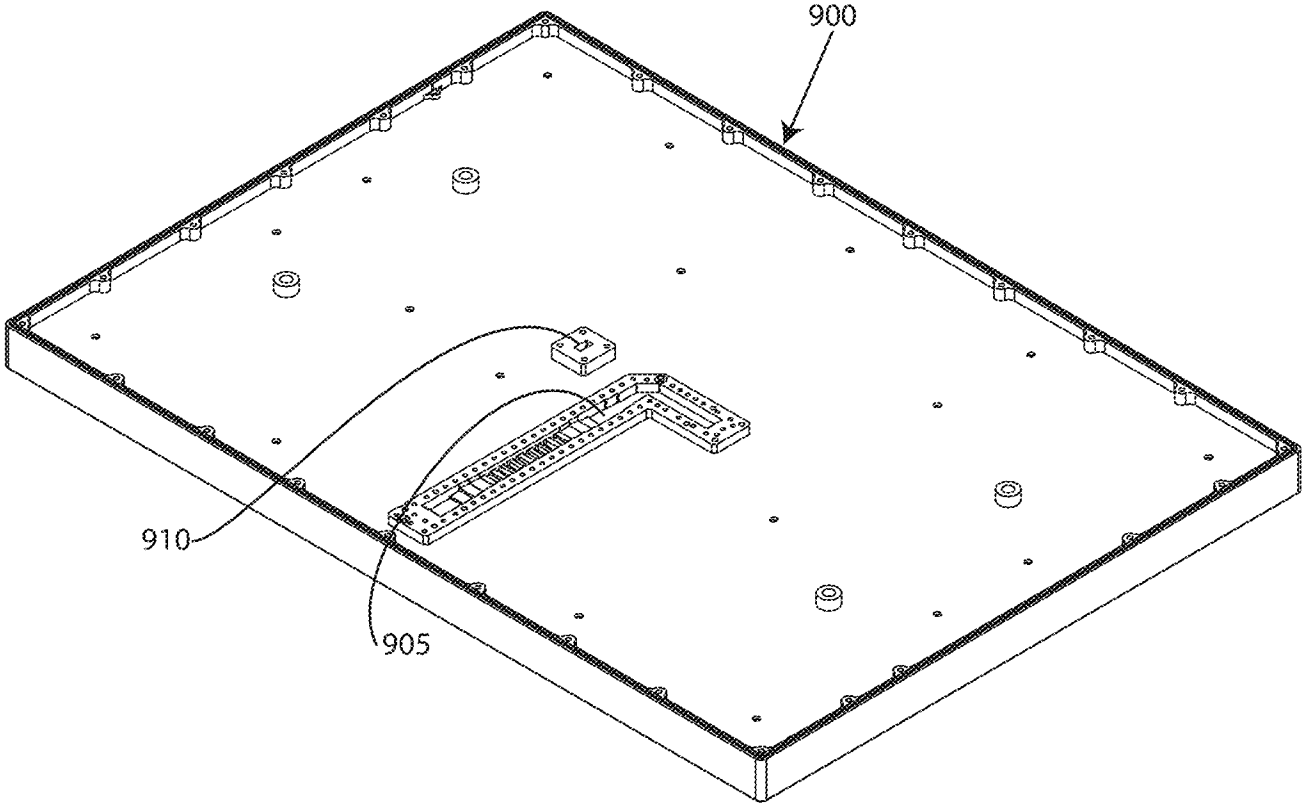
FIG. 24 conceptually illustrates a terminal waveguide (interface adapter) layer according to principles of the invention.

FIG. 24 conceptually illustrates a terminal waveguide layer 900 according to principles of the invention. A transmit adapter interface 905 and a receive adapter interface 910 are provided. The interfaces 905, 910 allow connection to waveguides and/or coaxial cables. The adapter interfaces 905, 910 align with outlet 840 and inlet 885.

Any dimensions are provided as approximate dimensions for an embodiment. Dimensions may be varied without departing from the scope of the invention. Varied dimensions that do not substantially impair utility of the invention come within the spirit and scope of the invention. Subject to the foregoing, unless otherwise specified herein, dimensions may be varied by ±5% without departing from the scope of the invention.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A multi-layer antenna assembly comprising a driven printed circuit board (PCB) layer, including a plurality of receive elements and a plurality of transmit elements, and adjacent transmit elements being equally spaced apart, and spacing between adjacent transmit elements being less than a transmit wavelength, and adjacent receive elements being equally spaced apart, and spacing between adjacent receive elements being less than a receive wavelength, each receive element being disposed between a group of transmit elements;

a receive waveguide layer providing a receive waveguide operably coupled to the plurality of receive elements, and a transmit waveguide layer providing a transmit waveguide operably coupled to the plurality of transmit elements, the receive waveguide layer being separate from the driven printed circuit board (PCB) layer and the transmit waveguide layer, and the transmit waveguide layer being separate from the driven printed circuit board (PCB) layer and the receive waveguide layer.

2. The multi-layer antenna assembly of claim 1, further comprising a receive combiner PCB layer, the receive combiner PCB layer including a plurality of groups of first pads and a plurality of receive combiner pads, each group of first pads including a plurality of first pads conductively coupled to a receive combiner pad of the plurality of receive combiner pads, and each receive element of the driven PCB layer being conductively coupled to one of the plurality of first pads of the receive combiner layer.

3. The multi-layer antenna assembly of claim 2, further comprising a transmit combiner PCB layer, the transmit combiner PCB layer including a plurality of groups of second pads and a plurality of transmit combiner pads, each group of second pads including a plurality of second pads conductively coupled to a transmit combiner pad of the plurality of transmit combiner pads, and each transmit element of the driven PCB layer being conductively coupled to one of the plurality of second pads of the transmit combiner layer.

4. The multi-layer antenna assembly of claim 3, wherein each group of the plurality of groups of first pads of the receive combiner PCB layer contains 16 first pads.

5. The multi-layer antenna assembly of claim 4, wherein each group of the plurality of groups of second pads of the transmit combiner PCB layer contains 16 second pads.

6. The multi-layer antenna assembly of claim 5, the first conductive metallic layer further comprising a plurality of openings, each opening of the plurality of openings being aligned with one of the transmit combiner pads of the plurality of receive combiner pads.

7. The multi-layer antenna assembly of claim 6 further comprising a first waveguide adapter interface coupled with the window in the second conductive metallic layer of the second waveguide layer aligned with the first port of the first conductive metallic layer, and a second waveguide adapter interface coupled with the second port in the second conductive metallic layer of the second waveguide layer.

8. The multi-layer antenna assembly of claim 4 the transmit waveguide layer comprising a second conductive metallic layer with a second port extending therethrough, a plurality of interconnected transmit waveguide channels formed in the metallic layer and configured to propagate the second electromagnetic wave, the plurality of interconnected transmit waveguide channels including an interconnected transmit waveguide channel with a second aperture corresponding to each transmit combiner pad, each second aperture being aligned with the corresponding transmit combiner pad, and each second aperture being configured to propagate a second electromagnetic wave from the interconnected transmit waveguide channel to the corresponding transmit combiner pad.

9. The multi-layer antenna assembly of claim 8, the second conductive metallic layer further comprising a window aligned with the first port of the first conductive metallic layer.

10. The multi-layer antenna assembly of claim 9 wherein the second conductive metallic layer comprises a second metal plate with each of the second port, the plurality of interconnected second waveguide channels, and each second aperture and the window being milled into the second metal plate.

11. The multi-layer antenna assembly of claim 3, the receive waveguide layer comprising a first conductive metallic layer with a first port extending therethrough, a plurality of interconnected receive waveguide channels formed in the metallic layer and configured to propagate a first electromagnetic wave, the plurality of interconnected receive waveguide channels including an interconnected receive waveguide channel with a first aperture corresponding to each receive combiner pad, each first aperture being aligned with the corresponding receive combiner pad, and each first aperture being configured to propagate the first electromagnetic wave from the corresponding receive combiner pad to the interconnected receive waveguide channel.

12. The multi-layer antenna assembly of claim 11, each second aperture being configured to propagate the second electromagnetic wave from the interconnected transmit waveguide channel to the corresponding transmit combiner pad via one of the openings of the plurality of openings of the first conductive metallic layer.

13. The multi-layer antenna assembly of claim 12 wherein the first conductive metallic layer comprises a first metal plate with each of the first port, the plurality of interconnected first waveguide channels, and each first aperture being milled into the first metal plate.

14. The multi-layer antenna assembly of claim 12 wherein the first waveguide adapter interface and the second waveguide adapter interface are formed on an adapter interface layer, the adapter interface layer comprising a third metal plate with each of the first waveguide adapter interface and second waveguide adapter interface being milled into the third metal plate.

15. The multi-layer antenna assembly of claim 1, the plurality of receive elements and the plurality of transmit elements forming a plurality of unit cells, each unit cell comprising one receive element and four transmit elements, the four transmit elements being arranged in a square configuration with each transmit element being located at a corner of the square configuration and a center of each transmit element of the four transmit elements being equidistant from a center of each adjacent transmit element of the four transmit elements, and the center of each transmit element of the four transmit elements being equidistant from a center of the one receive element of the unit cell, and each transmit element of the four transmit elements operating at transmit frequency having the transmit wavelength, and each distance from the center of each transmit element of the four transmit elements and the center of each adjacent transmit element of the four transmit elements being less than the transmit wavelength.

16. The multi-layer antenna assembly of claim 15, wherein the plurality of unit cells comprise a plurality of unit cells aligned in rows and columns, and the center of the one receive element of each unit cell being equidistant from the center of the one receive element in each adjacent unit cell, and the center of each transmit element of the four transmit elements of each unit cell being equidistant from the center of each adjacent transmit element of the four transmit elements in each adjacent unit cell.

17. The multi-layer antenna assembly of claim 16, wherein the one receive element of each unit cell operates at a receive frequency, the transmit frequency being different from the receive frequency, the transmit frequency being greater than the receive frequency.

18. The multi-layer antenna assembly of claim 17, the receive frequency being a Ka band downlink frequency and the transmit frequency being a Ka band uplink frequency.

19. The multi-layer antenna assembly of claim 15, the one receive element of each unit cell being configured to receive radio frequency electromagnetic radiation at a receive frequency and each transmit element of the four transmit elements of each unit cell being configured to transmit radio frequency electromagnetic radiation at the transmit frequency, the transmit frequency being greater than the receive frequency.

20. A multi-layer antenna assembly comprising a driven printed circuit board (PCB) layer, including a plurality of receive elements and a plurality of transmit elements, and adjacent transmit elements being equally spaced apart, and spacing between adjacent transmit elements being less than a transmit wavelength, and adjacent receive elements being equally spaced apart, and spacing between adjacent receive elements being less than a receive wavelength, each receive element being disposed between a group of transmit elements; and a receive waveguide layer providing a receive waveguide operably coupled to the plurality of receive elements, and a transmit waveguide layer providing a transmit waveguide operably coupled to the plurality of transmit elements, the receive waveguide layer being separate from the driven printed circuit board (PCB) layer and the transmit waveguide layer, and the transmit waveguide layer being separate from the driven printed circuit board (PCB) layer and the receive waveguide layer; and the receive waveguide layer comprising a first conductive metallic layer with a first port extending therethrough, a plurality of interconnected receive waveguide channels formed in the metallic layer and configured to propagate a first electromagnetic wave, the plurality of interconnected receive waveguide channels including an interconnected receive waveguide channel with a first aperture, each first aperture being configured to propagate a first electromagnetic wave from the receive elements to the interconnected receive waveguide channel; and the transmit waveguide layer comprising a second conductive metallic layer with a second port extending therethrough, a plurality of interconnected transmit waveguide channels formed in the metallic layer and configured to propagate a second electromagnetic wave, the plurality of interconnected transmit waveguide channels including an interconnected transmit waveguide channel with a second aperture, each second aperture being configured to propagate the second electromagnetic wave from the interconnected transmit waveguide channel to the transmit elements.

* * * * *